US006453821B1

(12) United States Patent
Fowler et al.

(10) Patent No.: US 6,453,821 B1
(45) Date of Patent: Sep. 24, 2002

(54) HIGH-TEMPERATURE OBTURATOR FOR A GUN-LAUNCHED PROJECTILE

(75) Inventors: Gray E. Fowler; G. Michael Liggett, both of Allen; Craig E. Prevost, Dallas; John W. Orem, Allen, all of TX (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/507,116

(22) Filed: Feb. 17, 2000

Related U.S. Application Data

(60) Provisional application No. 60/141,564, filed on Jun. 29, 1999.

(51) Int. Cl.[7] ..... F42B 14/00; F42B 14/02

(52) U.S. Cl. ..... 102/527; 102/524; 102/526; 102/520

(58) Field of Search ..... 102/524–527, 102/372, 373, 520

(56) References Cited

U.S. PATENT DOCUMENTS

| | | | | | |
|---|---|---|---|---|---|
| 910,935 | A | * | 1/1909 | Meyer | 102/524 |
| 1,861,522 | A | * | 6/1932 | Brandt | 102/527 |
| 2,454,801 | A | | 11/1948 | Himmer | 102/93 |
| 2,699,094 | A | | 1/1955 | Musser | 89/1.7 |
| 3,613,596 | A | * | 10/1971 | Walde | 102/372 |
| 3,660,192 | A | * | 5/1972 | Smith et al. | |
| 3,687,079 | A | | 8/1972 | Scollins | 102/49.2 |
| 3,760,736 | A | * | 9/1973 | Eig | 102/527 |
| 3,786,760 | A | * | 1/1974 | Feldmann | 102/527 |
| 3,910,194 | A | * | 10/1975 | Dehm et al. | 102/527 |

(List continued on next page.)

FOREIGN PATENT DOCUMENTS

| | | | | |
|---|---|---|---|---|
| DE | 37 31 034 A1 | | 3/1990 | F42B/14/00 |
| DE | 39 04 626 A1 | | 8/1990 | F42B/14/06 |
| DE | 37 30 359 A1 | | 1/1992 | F42B/14/06 |
| EP | 0 651 224 A1 | | 5/1995 | F41F/3/052 |
| FR | 815222 | | 7/1937 | |
| GB | 2 243 901 A | | 11/1991 | F42B/14/06 |
| JP | 404198697 A1 | * | 7/1992 | 102/526 |

OTHER PUBLICATIONS

PCT International Search Report dated Mar. 14, 2001 for PCT/US 00/17302 filed Jun. 22, 2000.

PCT International Search Report dated Nov. 22, 2000 for PCT/US00/17408 filed Jun. 22, 2000.

Soper, William G., "Spin–Decoupled Projectiles: Relationship of Spin to Muzzle Velocity," Journal of Engineering for Industry, Technical Briefs, Feb. 1976, pp. 381–382.

*Primary Examiner*—Michael J. Carone
*Assistant Examiner*—Lulit Semunegus
(74) *Attorney, Agent, or Firm*—Baker Botts L.L.P.

(57) ABSTRACT

An obturator is provided for a projectile launched from a gun barrel. The obturator includes an annular ring that is fabricated from a high-temperature resistant composite material. The annular ring has an inner surface that is in contact with the projectile. In addition, when the projectile is fired from the gun barrel, an outer surface of the annular ring contacts an inner surface of a bore of the gun barrel. When the projectile is fired from the gun barrel, the radial distance between the inner surface and the outer surface of the annular ring substantially equals or exceeds the radial distance between an outer surface of the projectile and the inner surface of the bore of the gun barrel at at least one point. This configuration restricts a flow of charge gases from an aft end of the projectile to a forward end of the projectile as the projectile is fired from the gun barrel.

14 Claims, 5 Drawing Sheets

U.S. PATENT DOCUMENTS

| | | | | | |
|---|---|---|---|---|---|
| 4,366,015 | A | * | 12/1982 | Murray | 156/185 |
| 4,413,567 | A | * | 11/1983 | Frostig | 102/372 |
| 4,520,731 | A | | 6/1985 | Götz et al. | 102/527 |
| 4,532,868 | A | * | 8/1985 | Gleichaut et al. | 102/527 |
| 4,552,071 | A | | 11/1985 | Horais et al. | 102/527 |
| H167 | H | * | 12/1986 | Forster et al. | 102/524 |
| 4,833,995 | A | | 5/1989 | Götz et al. | 102/521 |
| 4,907,513 | A | * | 3/1990 | Manion et al. | 102/527 |
| 5,081,931 | A | | 1/1992 | Frye et al. | 102/489 |
| 5,160,800 | A | | 11/1992 | Travor et al. | 89/1.57 |
| 5,503,080 | A | | 4/1996 | Goward et al. | 102/293 |
| 5,682,011 | A | * | 10/1997 | Sabranski et al. | 102/527 |
| 6,237,497 | B1 | * | 5/2001 | Altenau et al. | 102/524 |
| 6,295,934 | B1 | * | 10/2001 | Tepera et al. | 102/527 |

* cited by examiner

HIGH-TEMPERATURE OBTURATOR FOR A GUN-LAUNCHED PROJECTILE

RELATED APPLICATIONS

This application claims the benefit of U.S. provisional application Ser. No. 60/141,564, filed Jun. 29, 1999, entitled "HIGH-TEMPERATURE OBTURATOR FOR A GUN-LAUNCHED PROJECTILE".

TECHNICAL FIELD OF THE INVENTION

This invention relates generally to gun-launched projectiles and more particularly to a high-temperature obturator for a gun-launched projectile.

BACKGROUND OF THE INVENTION

When launching projectiles out of large military guns or cannons, the typical loading technique is to first ram the projectile into the breach of the gun, and then to ram a propelling charge in a shell casing behind the projectile. The propelling charge is typically positioned in the breach by a shell casing rim that is similar to the rim on a bullet cartridge used with a handgun. This rim is larger than the diameter of the breach and is prevented from being inserted into the barrel of the gun.

Projectiles launched from military guns are typically rear obturated. The aft end of the projectile has a protruding ring or flange of material called an obturator or a rotating band. The obturator has a diameter smaller than the diameter of the breach, but larger than the diameter of the bore of the gun barrel. The bore is the section of the barrel that typically contains a series of rifling grooves used to impart a spin on the projectile.

During loading, the projectile is rammed into the breach in a manner similar to putting a bullet in a gun chamber. However, unlike a typical bullet, the projectile does not have a cartridge rim to stop it (only the separate propelling charge has a cartridge rim). Therefore, the aft end or rear obturator is used to stop the projectile once it has traveled an appropriate distance into the barrel. Because the rear obturator has a diameter larger than the bore diameter of the gun, the obturator is stopped during loading of the projectile in an area of the gun barrel where the inside diameter decreases from the breach diameter to the bore diameter. This area of inside diameter change is called the forcing cone. Because the obturator is located at the rear of the projectile, when the obturator stops at the forcing cone, most of the projectile is positioned in the bore of the barrel.

When the propelling charge is ignited, the rear of the projectile is forced into the bore of the gun barrel. The obturator, which has a diameter larger than the bore of the gun, is forced to extrude into the rifling grooves. This extrusion helps to prevent the charge gases created by the ignition of the propelling charge from flowing past the projectile in the rifling grooves. By preventing the charge gases from blowing by the projectile, the obturator causes the charge gases to drive the projectile out of the gun at the optimal velocity. In addition, since the rifling grooves spiral down the barrel, the grooves impart a spin to the projectile to increase flight stability.

Advanced projectiles ("smart" projectiles) are capable of being fired from the same guns that are used to fire the standard unguided projectiles described above. An example of an unguided projectile is a standard artillery shell, which is basically an oversized bullet. On the other hand, advanced projectiles have enhanced features such as electronic guidance and extended range rocket motors. For example, certain advanced projectiles are launched from a gun using a propelling charge, but then use a rocket motor and a guidance system to propel them to a selected target. These advanced projectiles must be designed to be loaded and fired in the same gun barrels that were designed to fire the standard unguided projectiles. However, advanced projectiles are often three to four times longer than standard projectiles due to their increased complexity. Because of this increased length, if a standard rear obturator is used on such projectiles, the launch pressures created when the charge is ignited would buckle the aft portion of the advanced projectile.

An obturator or related device must be used in order to stop the charge gases from blowing by the projectile. This function is important in the case of advanced projectiles due to the sensitivity of the guidance electronics. Any blow-by could potentially destroy the projectile's operability. Additionally, a ramming brake is needed to stop the projectile when it is rammed into the gun. Traditionally, both of these functions have been performed by the rear obturator or rotating band, as described above. However, since the obturator cannot be located at the rear of the projectile on an advanced projectile, the standard rear obturator/rotating band is design used with unguided projectiles must be replaced by one or more components that serve the function of preventing or reducing the blow-by of charge gases during launch of the projectile.

SUMMARY OF THE INVENTION

Accordingly, a need has arisen for an obturator for use in conjunction with a gun-launched projectile that functions to prevent or reduce the blow-by of charge gases during the launching of the projectile. The present invention provides a high-temperature obturator for a gun-launched projectile that addresses this need.

According to one embodiment of the present invention, an obturator is provided for a projectile launched from a gun barrel. The obturator includes an annular ring that is fabricated from a high-temperature resistant composite material. The annular ring has an inner surface that is in contact with the projectile. In addition, when the projectile is fired from the gun barrel, an outer surface of the annular ring contacts an inner surface of a bore of the gun barrel. When the projectile is fired from the gun barrel, the radial distance between the inner surface and the outer-surface of the annular ring substantially equals or exceeds the radial distance between an outer surface of the projectile and the inner surface of the bore of the gun barrel at at least one point. This configuration restricts a flow of charge gases from an aft end of the projectile to a forward end of the projectile as the projectile is fired from the gun barrel.

Embodiments of the invention provide numerous technical advantages. For example, in one embodiment of the invention, a obturator is provided that operates to impede the flow of charge gases past the projectile in the gun barrel, even though the obturator may be positioned at a mid-body location on the projectile. This functionality is due, in part, to the ability of the obturator to withstand high temperatures existing in the barrel prior to launch. Such a mid-body obturator is typically needed when used in conjunction with extended-length projectiles. Furthermore, obturators incorporating the teachings of the present invention, whether positioned mid-body or elsewhere on the projectile, are lightweight and will break apart upon exiting the gun barrel. The low weight prevents interference with the operation of the projectile, while the break-up and low mass reduce collateral damage to people and equipment in the vicinity of the gun.

Other technical advantages are readily apparent to one skilled in the art from the following figures, descriptions, and claims.

BRIEF DESCRIPTION OF THE DRAWINGS

For a more complete understanding of the present invention and the advantages thereof, reference is now made to the following descriptions taken in connection with the accompanying drawings in which.

DETAILED DESCRIPTION OF THE INVENTION

Embodiments of the present invention and its advantages are best understood by referring to FIGS. 1 through 9B of the drawings, like numerals being used for like and corresponding parts of the various drawings.

Figure 1:
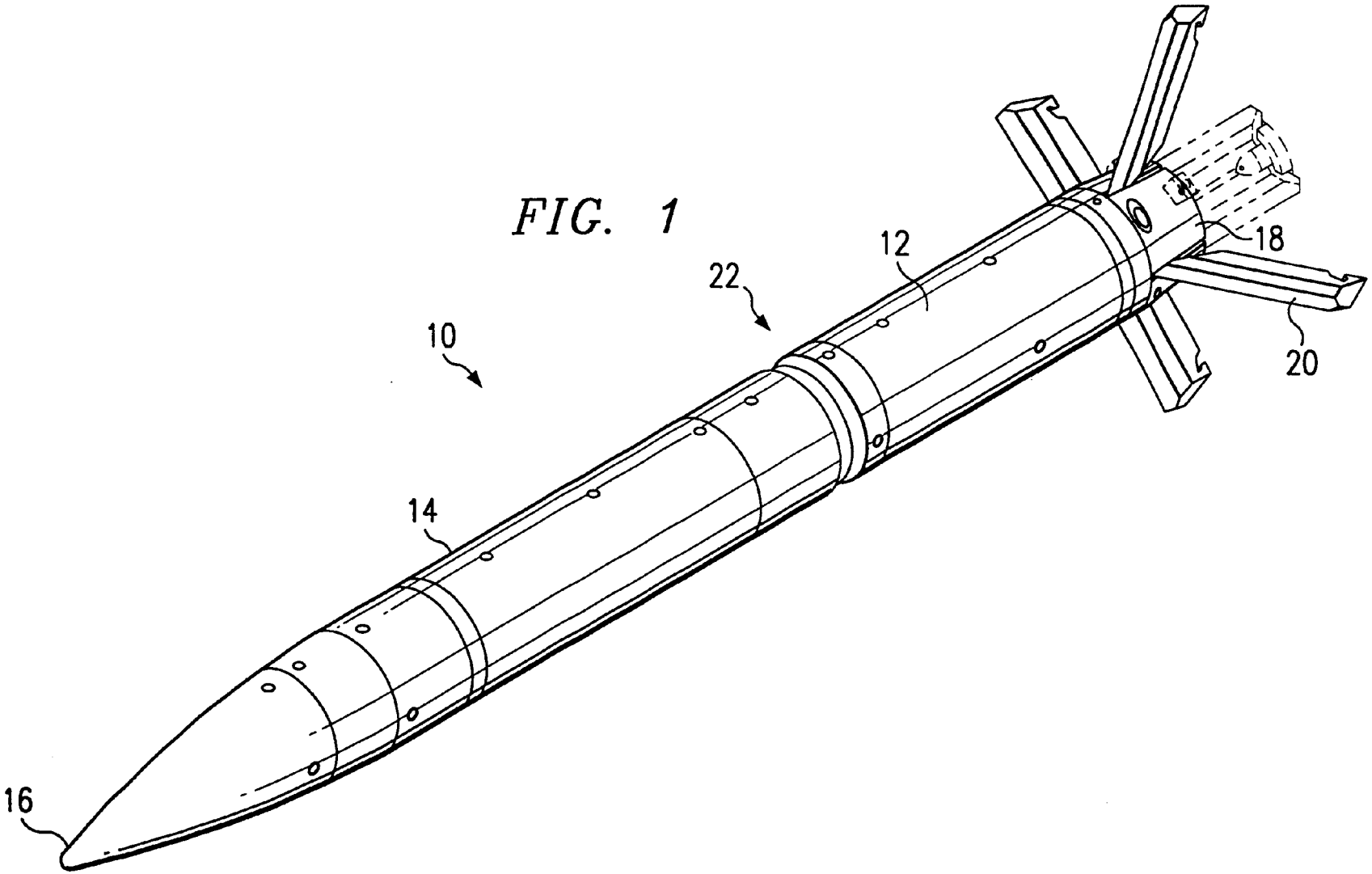
FIG. 1 is an illustration of a gun-launched projectile incorporating teachings of the present invention.

FIG. 1 illustrates a gun-launched projectile incorporating teachings of the present invention. The projectile 10 is an advanced or "smart" projectile that is fired from a gun that traditionally fires standard unguided projectiles. Examples of such guns are large naval and artillery guns. Projectile 10 includes a propulsion segment 12; typically a solid rocket motor. Once projectile 10 is fired from a gun, propulsion segment 12 ignites to accelerate the projectile to the desired velocity. Also included as a part of projectile 10 is a payload segment 14. Payload segment 14 includes the non-propulsion systems of the projectile. For example, payload segment 14 typically includes a plurality of sub-munitions or some other explosive device or devices. Typically, the payload segment also includes an electronics package for controlling the guidance of the projectile 10. Projectile 10 has a tip 16 at its forward end and an aft closure 18 at the aft end. Further, the projectile includes a plurality of fins 20 used to guide and stabilize the projectile. In addition, projectile 10 includes an obturator seat 22. Obturator seat 22 functions to position an obturator (not explicitly shown in FIG. 1). The function of the obturator and obturator seat 22 will described below.

Due to the length of advanced projectiles, a traditional rear obturator, as used on shorter, unguided projectiles that are fired from the same type of gun, cannot be used. If projectile 10 was rear obturated (meaning that the obturator is positioned at or in close proximity to the aft end of the projectile), the forces placed on the projectile when launched from the gun would cause propulsion segment 12 to buckle. The structure of propulsion segment 12 cannot be augmented to overcome this problem because too much weight would be added to the projectile.

However, if the obturator is moved near the middle of projectile 10 to a "mid-body" position, the launch forces applied to propulsion segment 12 are reduced by approximately half. This is due to the fact that payload segment 14 (or any structure that is forward of the obturator) bears approximately half the load, while propulsion segment 12 (or any structure aft of the obturator) bears the other half. In addition, the forces that are applied to propulsion segment 12 are generally tensile when a "mid-body" obturator is used. When a rear obturator is used, the forces on propulsion segment 12 are generally compressive. Due to the reduction of launch forces and the fact that the tensile strength of propulsion segment 12 is typically better than its compressive strength, a "mid-body" obturator is superior to a rear obturator for use with advanced projectiles such as projectile 10.

For the reasons described above, obturator seat 22 is generally located near the middle of projectile 10. However, there is no strict requirement that the obturator be located at the exact center of projectile 10. All that is required is that the obturator be positioned at substantially a mid-body location to lower the launch forces applied to propulsion segment 12. As will be discussed below, this generally means that the obturator, and thus obturator seat 22, is located at a point along projectile 10 that will be loaded into the bore of the gun barrel. For this reason, the obturator cannot have a larger outer diameter than the bore of the barrel.

Figure 2:
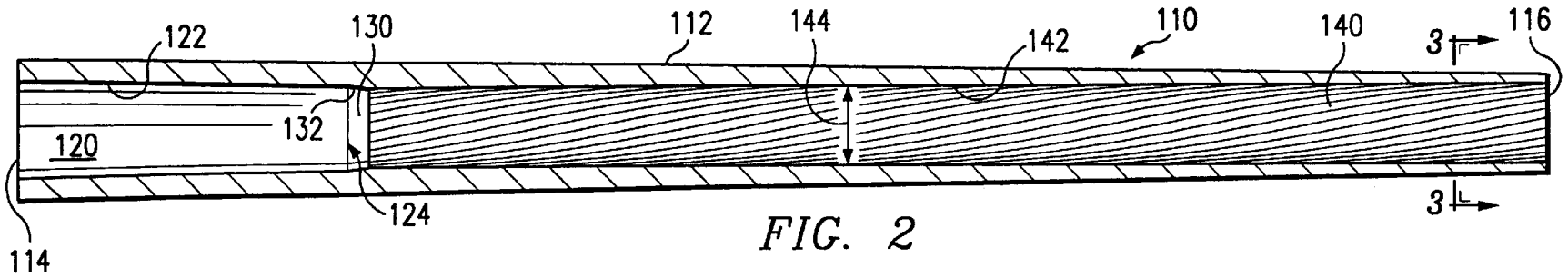
FIG. 2 is a cross-section illustrating a gun barrel used for launching the projectile of FIG. 1.
Figure 3:
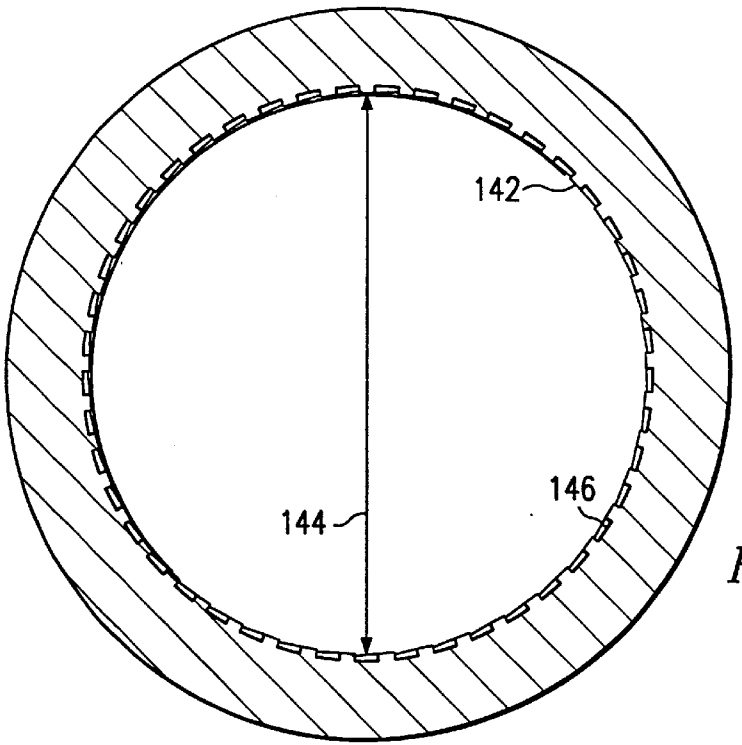
FIG. 3 is a cross-section of the gun barrel of FIG. 2, taken along line 3—3.

In order to further explain the configuration of the obturator and obturator seat 22, reference is now made to FIGS. 2 and 3. FIG. 2 is an illustration of a gun barrel for typically launching projectile 10. Included in the barrel 110 are three primary sections: a breach 120, a forcing cone 130, and a bore 140. Barrel 110 has three distinct inner surfaces corresponding to these sections. An inner surface 122 of breach 120 tapers slightly inward from an aft end 114 to a forward end 124. An inner surface 142 of bore 140 is of a uniform bore diameter 144 throughout the length of the bore. The diameter of the breach at the forward end 124 is larger than bore diameter 144. Thus, an inner surface 132 of forcing cone 130 forms a tapered cone that connects inner surface 122 of breach 120 to inner surface 142 of bore 140.

FIG. 3 illustrates a cross-section of bore 140 of FIG. 2, taken along line 3–3. Machined within the bore 140 is a plurality of rifling grooves 146 formed in inner surface 142. Rifling grooves 146 generally begin at the point where forcing cone 130 ends and where bore 140 begins. Each rifling groove spirals along bore 140 at a constant angle until reaching a forward end 116 of barrel 110. Rifling grooves 146 impart rotation to a projectile after the charge has been fired and the projectile travels along bore 140. Such rotation is needed to give unguided projectiles stability in flight.

Referring now to FIGS. 2 and 3, when a rear obturated projectile is loaded into barrel 110, the projectile is first inserted into breach 120. The projectile has a diameter less than, but substantially equal to bore diameter 144. Therefore, the projectile will travel along barrel 110 and into bore 140 until the obturator reaches forcing cone 130. A typical rear obturator has an outside diameter that is smaller than the diameter of breach 120 at the forward end 124, but larger than bore diameter 144. Therefore, when the obturator enters forcing cone 130, the obturator will come into full contact with inner surface 132 at a point where the inside diameter of forcing cone 130 generally equals the outside diameter of the obturator. At this point, the rear obturator is prevented from moving forward, thus stopping the projectile. Therefore, the first function of the rear obturator is to act as a ramming brake to prevent the projectile from completely entering bore 140.

Once the projectile has been stopped, a propelling charge is inserted into breach 120 behind the projectile. The projectile is then fired by igniting the propelling charge. A rear obturator is typically made of metal, such as copper or gilding metal. The flow of charge gases created by the ignition of the propelling charge creates enough force to deform the rear obturator and force the aft end of the projectile into bore 140. As the obturator is forced into bore 140, it is extruded into rifling grooves 146. The obturator serves two other functions at this point. The first function is to impart a spin to the projectile by following the spiraling configuration of rifling grooves 146 as the projectile travels along bore 140. The other function is to at least partially block the rifling grooves so that the charge gases are obstructed from flowing past the projectile. This later function is useful, but not critical, when using a standard unguided projectile.

Referring now to FIGS. 1, 2 and 3 in combination, as described above, a rear obturator cannot be used with projectile 10. Instead, a "mid-body" obturator is utilized to minimize the charge gases from traveling through rifling grooves 146. However, when the projectile is loaded into barrel 110, most of the projectile, including the obturator seat 22 is positioned in bore 140 to enable loading of the propelling charge in breach 120. Therefore, the obturator generally cannot have an outer diameter larger than bore diameter 144.

Because the outer diameter of the mid-body obturator is smaller than bore diameter 144, and since the obturator is positioned in bore 140 before firing, the mid-body obturator may not be extruded into rifling grooves 146 through the use of the forcing cone, as with a rear obturator. As discussed above, the function of stopping charge gas blow-by through the rifling grooves is important when using an advanced projectile. This is because such a projectile typically has an electronics package that can be easily damaged by the extreme heat and pressure of the charge gases. A traditional rear obturator design cannot be positioned mid-body on projectile 10.

Figure 4A:
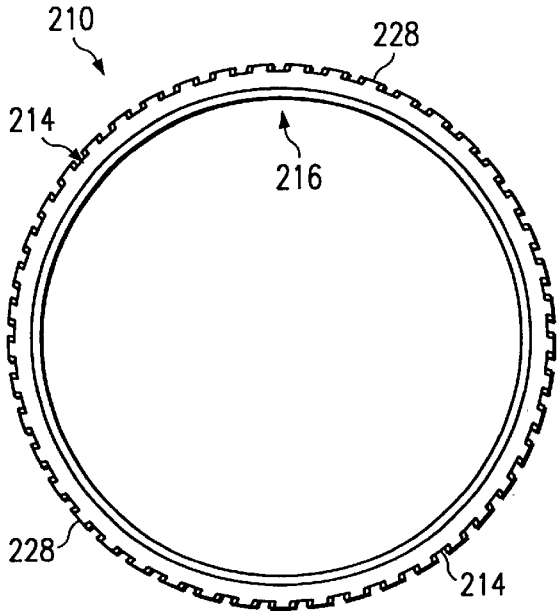
FIG. 4A shows a front view of an obturator incorporating teachings of the present invention.
Figure 4B:
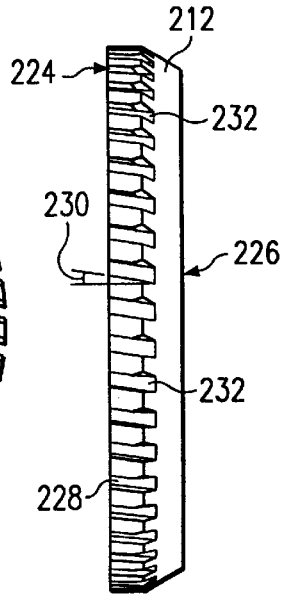
FIG. 4B illustrates a side view of the obturator of FIG. 4A.
Figure 4C:
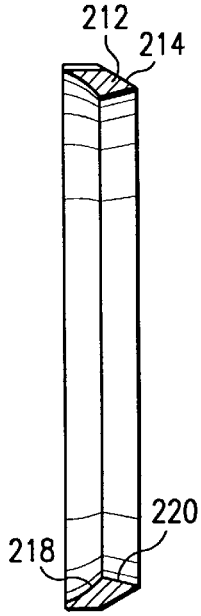
FIG. 4C shows a cross-section of the obturator of FIG. 4A.

Referring now to FIGS. 4A–4C, an obturator 210 incorporating teachings of the present invention is illustrated in front, side, and cross-sectional views, respectively. Obturator 210 has a configuration to be assembled around an associated projectile in an obturator seat. The obturator has a main body 212 shaped as an annular ring having an outer surface 214 and in inner surface 216. A plurality of tabs 228, discussed below, are positioned around outer surface 214.

Inner surface 216 has two distinct surfaces. The first such surface is a curved surface 218. Curved surface 218 forms an "ogive" shape toward an aft end 224 of obturator 210. The curved surface helps direct the charge gases to expand or "inflate" the obturator when the associated projectile is fired, as will be discussed in greater detail in conjunction with FIGS. 9A and 9B. Inner surface 216 further includes a ramp surface 220. Ramp surface 220 is configured to contact a ramp of the associated obturator seat.

As described above, the portion of the projectile 10 containing the obturator 210 is disposed in the bore of the gun barrel prior to firing. For this reason, the outer surface of obturator 210 has a diameter that is less than or generally equal to the bore diameter of the barrel. Obturator 210 includes tabs 228 positioned around outer surface 214. The outer diameter of all the tabs 228 is generally greater than the bore diameter of the gun, and are configured to fit into the rifling grooves in the bore. The number of tabs 228 is generally equal to the number of rifling grooves. Because the tabs fit into the rifling grooves before firing, obturator 210 does not have to be extruded into the grooves like a traditional rear obturator. For this reason, the tabs operate to seal the grooves more quickly and completely than a traditional rear obturator. This reduces or substantially eliminates the amount of charge gases that reach the projectile's sensitive electronic equipment.

In order to assure a tight seal, the tabs have a width and height approximately equal to the width and depth, respectively, of the associated rifling grooves. In addition, because the rifling grooves spiral around the bore of the gun barrel at a constant angle, each tab 228 should be positioned on outer surface 214 at an angle 230 that is approximately equal to the spiral angle of the rifling grooves around the bore.

In one embodiment of the obturator there is included features that assist in the loading of the projectile into the gun. For instance, tabs 228 have an inclined forward section 232 that helps to guide the tabs into the associated rifling grooves. In addition, since obturator 210 is typically fabricated from a flexible material, if the tabs are not aligned with the rifling grooves when obturator 210 initially enters the bore, the tabs and the entire aft end 224 of the obturator are impressed inward. As the projectile continues into the bore of the gun, the tabs "pop" into the grooves when subsequently aligned. The use of such "depressible" tabs allows the projectile to be loaded into the gun barrel without regard to the position of the tabs.

The material or materials used to fabricate obturator 210 must meet certain requirements. First, the material must be able to withstand extreme temperatures. The gun barrel can reach temperatures of approximately eight hundred degrees Fahrenheit, and obturator 210 must be able to withstand this temperature while positioned in the barrel before firing. In addition, the projectile may experience below freezing temperatures during storage or when it is deployed in the field. Furthermore, when the propulsion charge is ignited, there is an extreme build-up of gas pressure against the obturator. Obturator 210 must be constructed of a material or materials that can withstand this pressure. Finally, as described below in conjunction with FIGS. 9A and 9B, the obturator preferably expands during firing to fill the rifling grooves and any space between the projectile and the bore of the gun. Such expansion requires that the obturator material elongate one hundred to two hundred percent in localized areas.

The combination of extreme temperatures, high pressures, and the local elongation required of the material eliminates the use of many materials. In a particular embodiment of the present invention, obturator 210 is comprised of a combination of substances that form a "composite" material which meets the above requirements. The first substance used to fabricate this composite material is an elastomeric material, such as a perfluoroelastomer or silicone. These elastomeric materials exhibit the required elongation and temperature resistance, and do not become brittle or lose their elongation properties at cold temperatures. These materials can also handle the high temperature of the barrel for periods of time well in excess of-what is needed for launch of the projectile. However, silicone and perfluoroelastomer cannot withstand the pressures created when the gun is launched. Therefore, these materials need to be reinforced. However, the reinforcing material must allow the elastomeric material to retain its ability to elongate.

Reinforcing the silicone with short fibers, such as fiberglass, will decrease the tear strength of the obturator. On the other hand, continuous fibers such as glass, carbon and aramid fibers alone may not have enough elongation to allow the obturator to function. Specialized fabrics may be used that are fabricated from continuous fibers, but that still have the elongation properties required of the obturator. Such fabrics include, but are not limited to, knitted textiles, continuous strand mats, and felt-type products of either glass or aramid fibers (sold under the trademark KEVLAR). These fabrics are commercially available, and exhibit the elongation and temperature properties required of the obturator. These fabrics alone do not have sufficient strength to withstand the launch pressures, nor are they able to form an adequate gas seal. However, when placed in combination with the elastomeric material, the composite material that is formed meets all of the strength, temperature and elongation requirements.

This composite material may be fabricated using common methods of producing composite materials. Such methods include, but are not limited to, transfer molding of the elastomeric material onto a dry fiber pre-form, resin transfer molding of the elastomeric material onto a dry fiber preform, and a vacuum bag lay up using layers of the fabric material that are pre-impregnated with the elastomeric material (prepreg layers).

It should be noted that other materials are available for the fabrication of obturator 210. Obturator 210 may be formed entirely from a metal, such as copper or gilding metal. Many metals meet the temperature, pressure, and elongation properties discussed above, and are available for use to construct obturator 210. However, it should be noted that fabricating tabs 228 from metal may create jamming problems during loading of the projectile. The use of composite material typically does not create such problems. On the other hand, an all-composite obturator is not as strong as a metal obturator, and has a greater propensity to break apart prematurely in the gun barrel. A two-part obturator that includes an all-composite component and an additional metallic component may be used to improve the overall strength of the obturator. Such a configuration is described below.

Figure 5B:
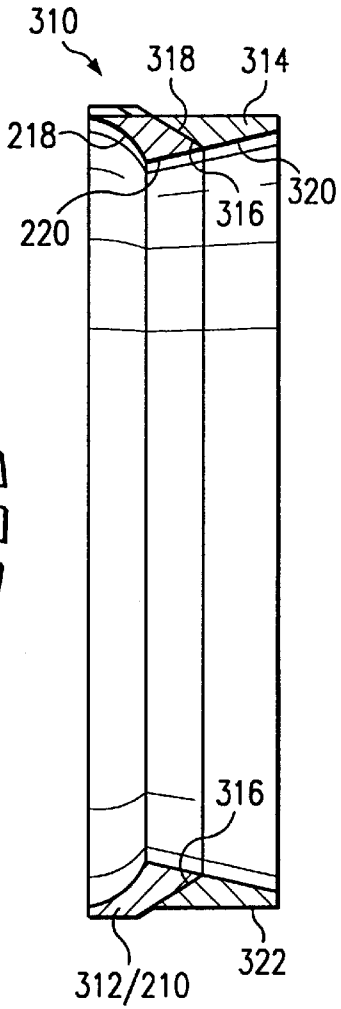
FIG. 5B shows a cross-section of the obturator of FIG. 5A.
Figure 5A:
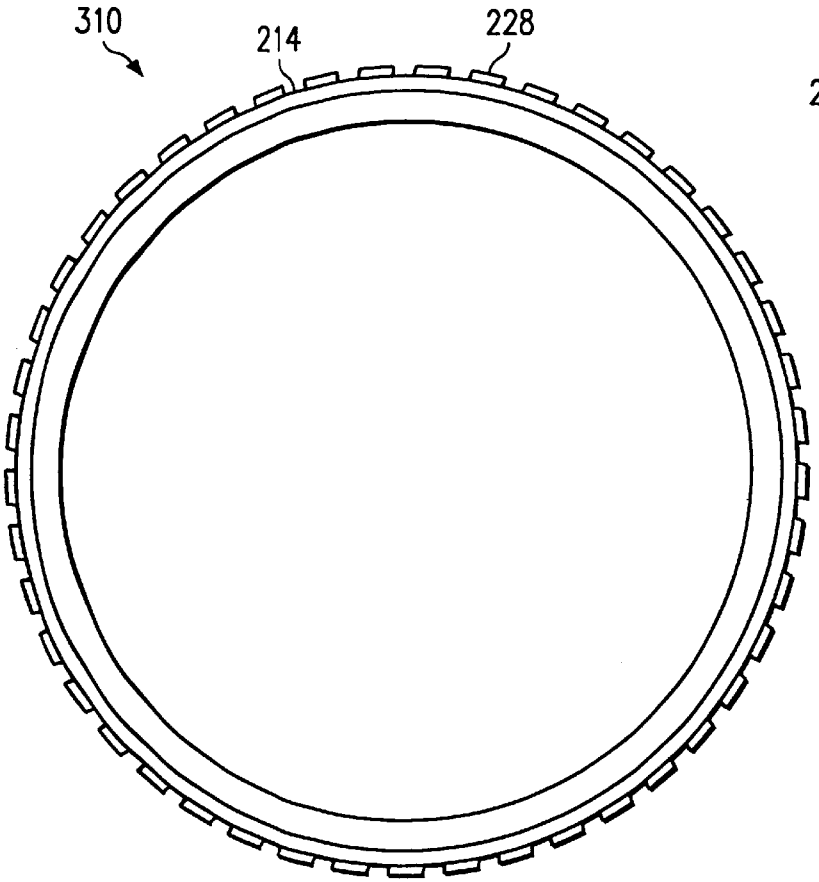
FIG. 5A is a front view of a two-piece obturator incorporating teachings of the present invention.

FIGS. 5A and 5B are schematic diagrams illustrating front and cross-sectional views, respectively, of a two-part obturator 310. Obturator 310 comprises a forward metallic portion 314 and an aft composite portion 312. Forward portion 314 and aft portion 312 may be referred to as forward annular ring and aft annular ring, respectively. In the illustrated embodiment, aft composite portion 312 comprises obturator 210, described above, made from composite material. The use of aft composite portion 312 having tabs 228, ensures that the rifling grooves are sealed when obturator 310 is initially contacted by the charge gases. In addition, as described above, the tabs typically do not create loading problems when fabricated from a composite material. However, because the composite material of aft composite portion 312 is brittle compared to a metal, there is a possibility that the composite material will break apart before the projectile has traveled an adequate distance through the gun barrel. For this reason, forward metallic portion 314 is utilized. Forward portion 314 typically comprises copper, gilding metal, or any other suitable metal. As will be described below, the forward metallic portion is partially extruded into the rifling grooves during firing of the projectile in order to aid the aft portion in minimizing the blow-by of charge gases.

Forward portion 314 is configured such that an aft surface 316 of the forward portion abuts and conforms with a forward surface 318 of aft portion 312. In addition, in the illustrated configuration, ramp surface 220 of the aft portion is generally continuous with a ramp surface 320 of the forward portion. As with ramp surface 220, ramp surface 320 is configured to conform with the ramp of the obturator seat. The interaction of ramp surface 320 and the ramp will be discussed below in conjunction with FIGS. 9A and 9B. Furthermore, forward portion 314 includes an outer surface 322 that is generally continuous with outer surface 214 of aft portion 312. The forward portion and the aft portion are interconnected using an appropriate fastener or adhesive. In the alternative, both portions are not connected, but are assembled adjacent to one another in the obturator seat.

Figure 6A:
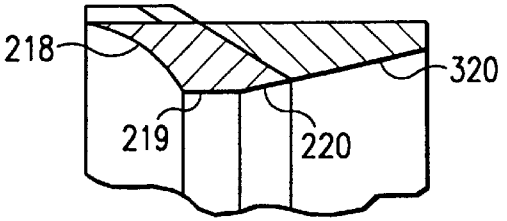
FIG. 6A illustrates a cross-section with portions broken away of a first modification of the obturator of FIG. 5A.
Figure 6B:
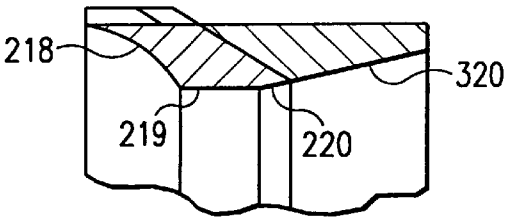
FIG. 6B illustrates a cross-section with portions broken away of a second modification of the obturator of FIG. 5A.
Figure 6C:
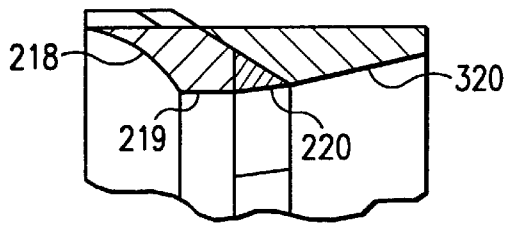
FIG. 6C illustrates a cross-section with portions broken away of a third modification of the obturator of FIG. 5A.

It should be understood that the aft portion of obturator 310 may have alternate configurations. For example, although the aft portion (and obturator 210) have been illustrated and described as having an inside surface comprising only a curved surface 218 and a ramp surface 220, the inside surface in an alternate configuration includes a flat surface 219. Alternate configurations, including flat surface 219, are illustrated in FIGS. 6A–6C.

Figure 7A:
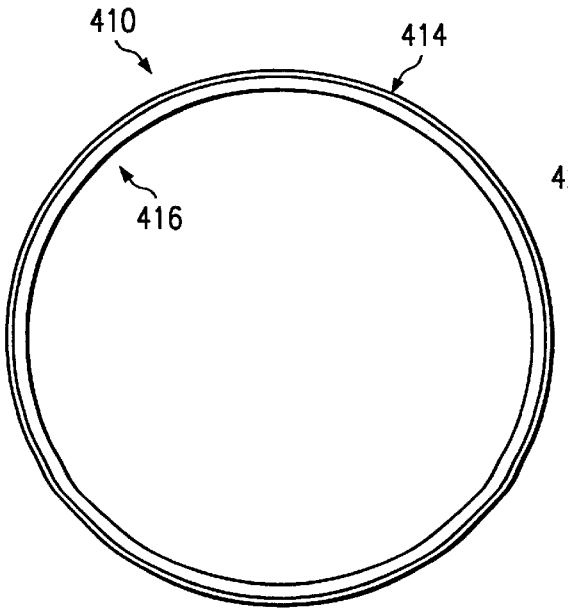
FIG. 7A shows a front view of yet another obturator incorporating teachings of the present invention.
Figure 7B:
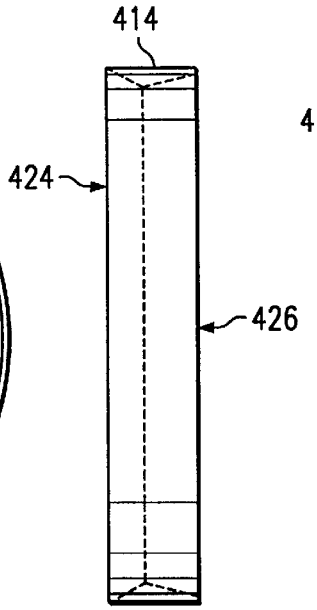
FIG. 7B illustrates a side view of the obturator of FIG. 7A.
Figure 7C:
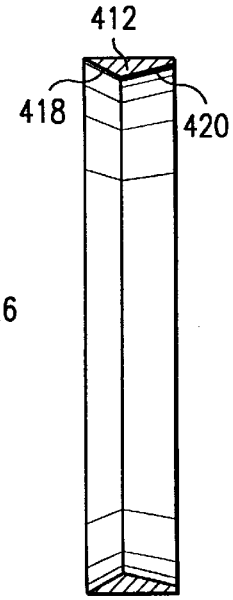
FIG. 7C shows a cross-section of the obturator of FIG. 7A.

Referring now to FIGS. 7A–7C, there is illustrated another obturator 410 incorporating teachings of the present invention in front, side, and cross-sectional views, respectively. Obturator 410 is configured to be assembled around an associated projectile in the obturator seat. Obturator 410 has a main body 412 shaped as an annular ring having an outer surface 414 and an inner surface 416. The inner surface 416 includes two distinct surfaces, aft surface 418 and ramp surface 420. The aft surface starts at an aft end 424 of obturator 410 and tapers inwardly. Although aft surface 418 is illustrated as a linearly tapering surface, it may also comprise a curved surface similar to curved surface 218 of obturator 210 (shown in FIG. 4C). The aft surface directs the charge gases created when the projectile is launched such that the gases expand or "inflate" the obturator when the projectile is fired. The inner surface further includes a ramp surface 420 that generally extends to a forward end 426 of the obturator. The ramp surface 420 is configured to contact a ramp of the associated obturator seat.

Unlike obturators 210 and 310, obturator 410 does not include tabs that engage the rifling grooves of the gun barrel during loading. Therefore, in order to seal the rifling grooves, obturator 410 is typically made from a material that can be extruded by the launch forces into the rifling grooves (as with forward metallic portion 314 of obturator 310). This extrusion is accomplished by the "inflation" of obturator as it is moved up a ramp of the obturator seat during firing. Such inflation will be described below in conjunction with FIGS. 9A and 9B. In addition, the material from which obturator 410 is fabricated must withstand the pressure and temperature conditions found in the gun barrel, as described above. In order to meet these requirements, obturator 410 will typically be fabricated from a metal, such as copper or gilding metal.

Figure 8A:
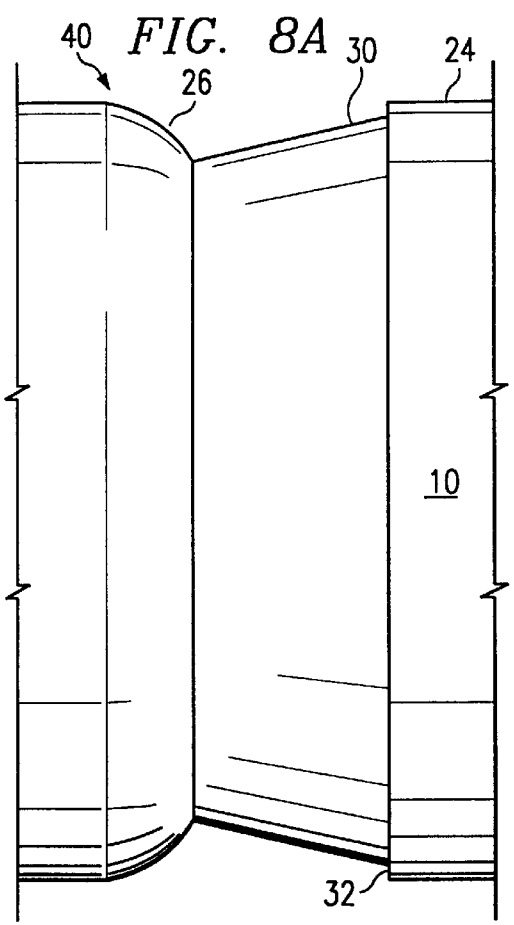
FIG. 8A is an illustration of an obturator seat of a projectile incorporating teachings of the present invention.
Figure 8B:
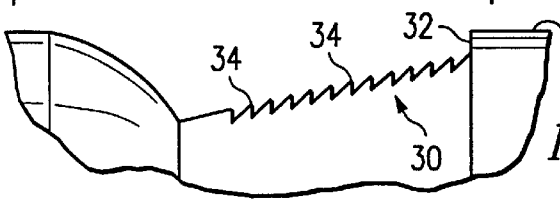
FIG. 8B is an illustration of another obturator seat incorporating teachings of the present invention.

FIG. 8A is a schematic diagram of the projectile shown in FIG. 1 with parts broken away to illustrate obturator seat 22. Obturator seat 22 is a shaped annular groove that is formed into an outer surface 24 of projectile 10. As discussed above, the obturator seat 22 is located along the length of the projectile such that it is positioned in the bore of the gun when the projectile is loaded into the barrel for firing. Therefore, an obturator (excluding any tabs) positioned in seat 22 preferably does not extend past surface 24 of the projectile. Thus, the depth of seat 22 is sized to accommodate the thickness of the obturator. Likewise, the length of the obturator seat should be at least as long as the longitudinal dimension of the obturator. As will be discussed below in conjunction with FIGS. 9A and 9B, seat 22 is preferably longer than the longitudinal dimension of the obturator.

Obturator seat 22 has a curved surface 26 that forms an ogive shape at an aft end 40. Curved surface 26 extends from outer surface 24 to a ramp 30. When projectile 10 is fired from the gun barrel, the charge gases flow around the projectile on outer surface 24. For reasons discussed below in conjunction with FIGS. 9A and 9B, it is desirable that the charge gases flow into and not over seat 22. However, when a gas flowing along a cylinder encounters an abrupt change in the cylinder's surface, for example, a groove formed in the cylinder, the gas flow has a tendency to separate from the surface of the cylinder and flow over the groove.

Due to the shape of the curved surface 26, the flow of gases follows the curved surface, and thus the flow is directed into seat 22. In a particular embodiment, curved surface 26 comprises a von Karman curve, but any curve or other configuration that minimizes flow separation may also be utilized. An example of another surface is a area of linearly decreasing diameter, similar to ramp 30, described below.

Curved surface 26 terminates at the ramp 30. The ramp 30 has a linearly increasing diameter that forms a cone extending from the curved surface. In the illustrated embodiment, ramp 30 extends to a forward wall 32. The ramp shown in FIG. 8A has a generally smooth surface. In another embodiment, illustrated in FIG. 8B, the surface of the ramp has a series of serrations 34 that are inclined towards forward wall 32. These serrations allow the obturator to slide up ramp 30, but inhibit the obturator from sliding back down the ramp. Such serrations 34, or other methods of preventing the obturator from sliding down the ramp, are useful to counteract the force of friction applied on the obturator by the bore of the gun barrel as the projectile travels along the bore. Such retraction by the obturator down ramp 30 results in a degradation of the seal that is formed by the obturator.

In another embodiment, the seat 22 includes a flat surface (not explicitly shown). In such configurations, the flat surface is an area of generally uniform diameter between curved surface 26 and ramp 30. A flat surface is included to conform with obturator configurations having a flat surface (such as flat surface 219, illustrated in FIGS. 6A–6C). The functions of curved surface 26, the bottom surface, ramp 30, and forward wall 32, and the interactions of these surfaces with the obturator disposed in seat 22, are discussed in conjunction with FIGS. 9A and 9B.

Figure 9B:
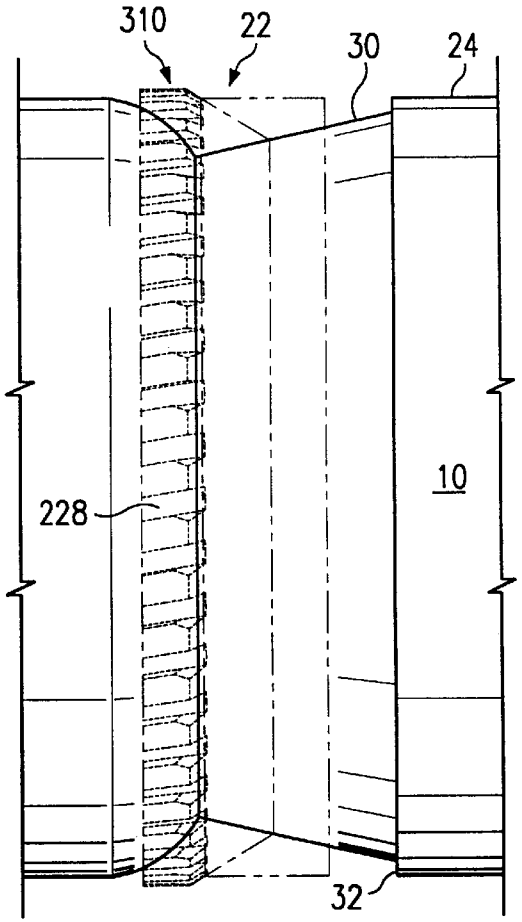
FIG. 9B illustrates the obturator of FIG. 5A in phantom lines positioned in the obturator seat of FIG. 8A.
Figure 9A:
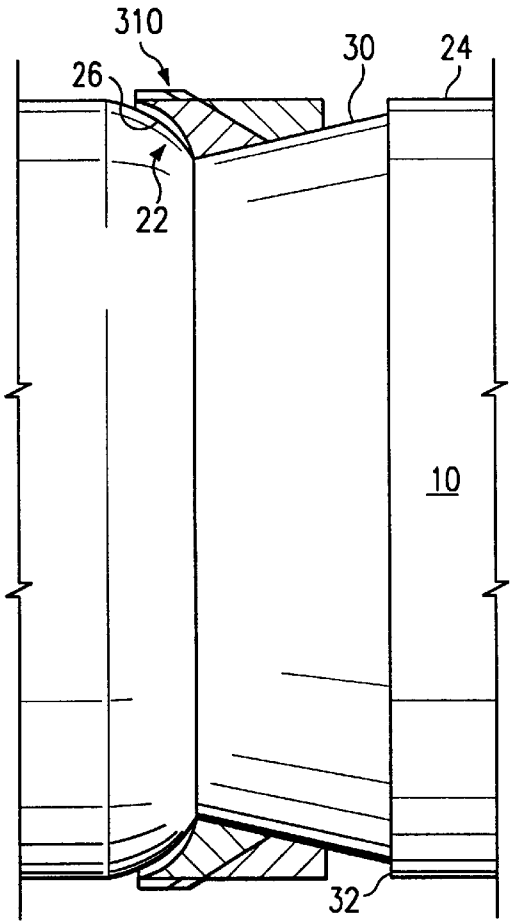
FIG. 9A shows the obturator of FIG. 5A in cross-section positioned in the obturator seat of FIG. 8A.

Referring now to FIGS. 9A and 9B, obturator 310 of FIGS. 5A and 5B is shown positioned in obturator seat 22 of FIG. 8A. FIG. 9A shows the obturator 310 in cross-section positioned in the obturator seat 22, and FIG. 9B illustrates the obturator in phantom lines positioned in the obturator seat. Obturator 310 is positioned in, but not affixed to, obturator seat 22. Initially, the outer surface 214 of aft composite portion 312 is generally flush with the outer surface 24 of projectile 10. Tabs 228 extend past outer surface 24 and into the rifling grooves of the gun barrel.

When the propelling charge is ignited, the charge gases flow rapidly up into the bore of the gun barrel. In the bore of the gun, the charge gases flow around outer surface 24 and through the rifling grooves. When the charge gases reach the obturator seat and the obturator, the curved surface 26 directs the charge gasses into the obturator seat. The charge gases then contact the aft portion 312 of the obturator and the obturator is pushed forward. Aft portion 312 is in contact with forward portion 314, and ramp surface 320 of forward portion 314 is pushed up ramp 30 until the forward portion contacts and stops against forward wall 32. As obturator 310 moves up ramp 30, both portions 312, 314 are forced to expand or "inflate." In addition, the charge gases also contact curved surface 218 of aft portion 312 and are directed inward, resulting in the further expansion of the aft portion 312.

As the obturator expands, the tabs of aft composite portion 312 are forced into the rifling grooves, thereby preventing most, if not all, of the charge gases from passing the obturator. In addition, due to curved surfaces 26 and 218, aft portion 312 continues to expand outward as tabs 228 are eroded in the rifling grooves. This feature ensures that a gas seal is maintained as the obturator experiences wear as it travels through the bore of the gun. Furthermore, the expansion of forward portion 314 causes the metal comprising this portion to extrude into the rifling grooves. Such extrusion also minimizes the passing of the charge gases through the rifling grooves. In addition, if the composite material of aft portion 312 fails, the forward metal portion 314 will remain to at least partially seal the grooves.

The constant outward pressure that is applied by as the obturator slides up ramp 30 also enables the use of all-metal obturators, such as obturator 410 illustrated in FIGS. 7A–7C, that do not include tabs. The main body of such obturators is extruded into the rifling grooves by this outward pressure, as with forward section 314 of obturator 310. However, without the presence of the tabs, the charge gases are initially allowed to pass by the obturator until the metal is sufficiently extruded into the rifling grooves. Although only a single configuration of obturator seat 22 corresponding to obturator 310 is illustrated, it will be understood that the obturator seat may be modified to conform with different types of obturators without departing from the scope of the present invention.

Furthermore, as stated above, the rifling grooves are typically used to impart a spin to a unguided projectile. This spin is usually imparted by extruding a rear obturator that is mounted to the projectile into the rifling grooves. The extruded obturator is spun as it travels through the spiral rifling grooves of the bore. Because the rear obturator is mounted to the projectile, this spin is imparted to the projectile. Similarly, the mid-body obturators of the present invention are also spun by the rifling grooves, either due to extrusion of the obturator into the grooves or due to the extension of tabs into the grooves. However, when such obturators are used with advanced projectiles, spinning is neither required nor desired. This is because advanced projectiles typically have fins and guidance systems that are used for stabilization.

Therefore, an obturator, such as obturator 310, may be decoupled from projectile 10. Such decoupling is accomplished by placing a lubricant, such as a dry-film lubricant, between the obturator and the obturator seat. Because the obturator is not affixed to the projectile, the spin of the obturator as it moves in the rifling grooves is not significantly imparted to the projectile. Instead the obturator functions like a slip ring and, when a dry-film lubricant is used, imparts a spin on the projectile that is only approximately ten to fifteen percent of the rate at which the obturator is spinning.

Although the present invention and its advantages have been described in detail, it should be understood that various changes, substitutions, and alterations can be made therein without departing from the spirit and scope of the present invention as defined by the appended claims.

What is claimed is:

1. An obturator for a projectile launched from a gun barrel, said projectile having an annular groove located substantially at a mid-body of the projectile, comprising:

an annular ring comprised of a high-temperature resistant composite material, the annular ring having an inner surface in contact with the annular groove of the projectile, and, with the projectile in the gun barrel, the annular ring has an outer diameter sized to fit within the inner diameter of the bore of the gun barrel resulting in an outer surface of the annular ring in contact with an inner surface of a bore of the gun barrel;

a plurality of substantially axially extending tabs positioned around the outer surface of the annular ring to engage into a plurality of rifling grooves formed in the bore of the gun barrel; and wherein the radial distance between the inner surface of the annular ring and the outer surface of the axially extending tabs substantially equals or exceeds the radial distance between the annular groove of the projectile and the inner surface of the rifling grooves of the bore of the gun barrel at at least one point, thereby restricting a flow of charge gases from an aft end of the projectile to a forward end of the projectile as the projectile travels through the gun barrel.

2. The obturator of claim 1, wherein the composite material comprises an elastomeric material in composition with a reinforcing fabric.

3. The obturator of claim 2, wherein the fabric is selected from the group consisting of a knitted textile, a continuous strand mat, and a fiber felt.

4. The obturator of claim 3, wherein the reinforcing fabric comprises aramid or glass fibers.

5. The obturator of claim 2, wherein the elastomeric material is selected from the group consisting of perfluoroelastomer and silicone.

6. An obturator for a projectile launched from a gun barrel, said projectile having an annular groove located substantially at a mid-body of the projectile, comprising:

an annular ring comprised of an elastomeric material in composition with a reinforcing fabric, the annular ring having an inner surface in contact with the annular groove of the projectile, and, with the projectile in the gun barrel, the annular ring has an outer diameter sized to fit within the inner diameter of the bore of the gun barrel resulting in an outer surface of the annular ring in contact with an inner surface of a bore of the gun barrel;

a plurality of substantially axial extending tabs positioned around the outer surface of the annular ring to engage into a plurality of rifling grooves formed in the bore of the gun barrel; and wherein the radial distance between the inner surface of the annular ring and the outer surface of the axially extending tabs substantially equals or exceeds the radial distance between the annular groove of the projectile and the inner surface of the rifling grooves of the bore of the gun barrel at at least one point, thereby restricting a flow of charge gases from an aft end of the projectile to a forward end of the projectile as the projectile travels through the gun barrel.

7. The obturator of claim 6, wherein the reinforcing fabric is selected from the group consisting of a knitted textile, a continuous strand mat, and a fiber felt.

8. The obturator of claim 7, wherein the reinforcing fabric comprises aramid or glass fibers.

9. The obturator of claim 6, wherein the elastomeric material is selected from the group consisting of perfluoroelastomer and silicone.

10. An obturator for a projectile launched from a gun barrel, said projectile having an annular groove located substantially at a mid-body of the projectile, comprising:

an annular ring comprised of a high-temperature resistant composite material, the annular ring having an inner surface in contact with the annular groove of the projectile, and, with the projectile in the gun barrel, the annular ring has an outer diameter sized to fit within the inner diameter of the bore of the gun barrel resulting in an outer surface of the annular ring in contact with an inner surface of a bore of the gun barrel;

plurality of substantially axial extending tabs positioned around the outer surface of the annular ring to engage into a plurality of rifling grooves formed in the bore of the gun barrel; and wherein the high-temperature resistant composite material expands upon firing of the projectile to substantially equal or exceed the radial distance between the annular groove of the projectile and the inner surface of the rifling grooves of the bore of the gun barrel at at least one point, thereby restricting a flow of charge gases from an aft end of the projectile to a forward end of the projectile.

11. The obturator of claim 10, wherein the composite material comprises an elastomeric material in composition with a reinforcing fabric.

12. The obturator of claim 11, wherein the fabric is selected from the group consisting of a knitted textile, a continuous strand mat, and a fiber felt.

13. The obturator of claim 12, wherein the reinforcing fabric comprises aramid or glass fibers.

14. The obturator of claim 11, wherein the elastomeric material is selected from the group consisting of perfluoroelastomer and silicone.

* * * * *

UNITED STATES PATENT AND TRADEMARK OFFICE

CERTIFICATE OF CORRECTION

PATENT NO. : 6,453,821 B1 
DATED : September 24, 2002
INVENTOR(S) : Gary E. Fowler et al.

It is certified that error appears in the above-identified patent and that said Letters Patent is hereby corrected as shown below:

Column 2,
Line 25, after “band” delete “is”.
Line 47, after “outer”, delete “-”.

Column 4,
Line 15, after “will” insert -- be --.

Column 7,
Line 17, after “excess of” delete “-”.

Column 9,
Line 43, after “surface is”, delete “a”, and insert -- an --.

Column 10,
Line 61, after “a spin to”, delete “a” and insert -- an --.

Column 12,
Line 41, prior to “plurality” insert -- a --.

Signed and Sealed this

Fourth Day of March, 2003

JAMES E. ROGAN
*Director of the United States Patent and Trademark Office*